US006814573B2

(12) United States Patent
Hiramoto

(10) Patent No.: US 6,814,573 B2
(45) Date of Patent: Nov. 9, 2004

(54) VACUUM HEAT-TREATMENT APPARATUS

(75) Inventor: Noboru Hiramoto, Aichi (JP)

(73) Assignee: JH Corporation, Aichi (JP)

( * ) Notice: Subject to any disclaimer, the term of this patent is extended or adjusted under 35 U.S.C. 154(b) by 0 days.

(21) Appl. No.: 10/315,941

(22) Filed: Dec. 11, 2002

(65) Prior Publication Data

US 2003/0113186 A1 Jun. 19, 2003

(30) Foreign Application Priority Data

Dec. 14, 2001 (JP) ..... 2001-381296

(51) Int. Cl.[7] ..... F27B 3/04

(52) U.S. Cl. ..... 432/239; 432/131; 432/163; 432/171; 414/938

(58) Field of Search ..... 432/128, 129, 432/131, 163, 171, 239; 414/935, 936, 937, 938, 217, 218, 219, 220, 939; 118/719; 156/345.31, 345.32

(56) References Cited

U.S. PATENT DOCUMENTS

| | | | | |
|---|---|---|---|---|
| 4,417,722 A | | 11/1983 | Ishii et al. | |
| 4,634,375 A | * | 1/1987 | Hailey | 432/121 |
| 4,951,601 A | * | 8/1990 | Maydan et al. | 118/719 |
| 5,033,927 A | | 7/1991 | Pelissier | |
| 5,404,894 A | * | 4/1995 | Shiraiwa | 134/66 |
| 5,512,320 A | | 4/1996 | Turner et al. | |
| 6,065,964 A | | 5/2000 | Pelissier | |
| 6,143,083 A | * | 11/2000 | Yonemitsu et al. | 118/719 |
| 6,231,290 B1 | * | 5/2001 | Kikuchi et al. | 414/221 |
| 6,234,788 B1 | * | 5/2001 | Lee | 432/124 |
| 6,391,114 B1 | * | 5/2002 | Kirimura | 118/719 |
| 6,503,365 B1 | * | 1/2003 | Kim et al. | 156/345.32 |

FOREIGN PATENT DOCUMENTS

| | | |
|---|---|---|
| EP | 0 423 710 A1 | 10/1991 |
| FR | 2 537 260 | 6/1984 |
| JP | 6-244124 | 9/1994 |
| JP | 8-178535 | 7/1996 |

OTHER PUBLICATIONS

Maeda Shuichi, "Multi–Chamber Type Heat Processing Furnace", Patent Abstract of Japan, vol. 1996, No. 11, Nov. 29, 1996, JP 08 178535, Dec. 7, 1996.

European Search Report, Mar. 18, 2003.

* cited by examiner

*Primary Examiner*—Gregory Wilson
(74) *Attorney, Agent, or Firm*—Nixon Peabody LLP; Donald R. Studebaker

(57) ABSTRACT

A vacuum heat-treatment apparatus for heat-treating a workpiece in a treating cell includes a hermetic chamber disposed at the center. A plurality of treating cells are disposed along the periphery of the hermetic chamber, and a workpiece transfer mechanism is disposed inside the hermetic chamber and transfers the workpiece from one of the treating cells to the hermetic chamber and from the hermetic chamber to one of the treating cells.

11 Claims, 6 Drawing Sheets

VACUUM HEAT-TREATMENT APPARATUS

BACKGROUND OF THE INVENTION

1. Field of the Invention

This invention relates to a vacuum heat-treatment apparatus for heat-treating a metal workpiece under vacuum and more particularly to such an vacuum heat-treatment apparatus provided with a workpiece transfer mechanism for transferring a workpiece from a treating cell in the vacuum heat-treatment apparatus to another.

2. Description of the Related Art

As a vacuum heat-treatment apparatus, there has been known a modular vacuum heat-treatment apparatus disclosed in U.S. Pat. No. 6,065,964. The vacuum heat-treatment apparatus comprises a plurality of treating cells horizontally joined to a hermetic chamber having a horizontal shaft. An additional module in the form of a cylinder having therein an additional treating cell can be joined to one end of the hermetic chamber, whereby a desired number of treating cells can be added in a horizontal direction.

Further, there has been disclosed another vacuum heat-treatment apparatus in U.S. Pat. No. 5,033,927. In the vacuum heat-treatment apparatus, a plurality of heating chambers (treating cells) are disposed in a star-like pattern in the upper portion of a doughnut-shaped hermetic chamber and a conveyor carriage which runs along a guide rail to transfer a workpiece from one treating cell to another is provided. The conveyor carriage runs below the treating cells and transfers the workpiece to a desired treating cell.

The vacuum heat-treatment apparatus of the former prior art is disadvantageous in that as the number of the treating cells increases, the overall length of the vacuum heat-treatment apparatus horizontally increases and the time required to transfer the workpiece from a certain treating cell to another certain treating cell is elongated. Depending on the kind of the treatment, the workpiece must be transferred from one cell to another in a short time. Especially in a vacuum heat-treatment apparatus, a metal workpiece heated to a high temperature must be quickly introduced into a hardening oil reservoir or a gas cooling cell in an oil hardening step or a gas cooling step. If it takes a long time to transfer the workpiece from the heating cell to the hardening oil reservoir or the gas cooling cell, the temperature of the workpiece lowers before the workpieces is introduced into the hardening oil reservoir or the gas cooling cell, which deteriorates the quality of the product obtained. Further since the vacuum heat-treatment apparatus is horizontally extended as the number of the treating cells increases, the space occupied by the vacuum heat-treatment apparatus increases in proportion to the number of the treating cells.

The vacuum heat-treatment apparatus of the latter prior art is disadvantageous in that the number of the treating cells is limited by the size of the hermetic chamber and increase of the throughput is limited.

SUMMARY OF THE INVENTION

In view of the foregoing observations and description, the primary object of the present invention is to provide a vacuum heat-treatment apparatus which allows a workpiece to be transferred from one of a plurality of treating cells to another treating cell in a short time.

Another object of the present invention is to provide a vacuum heat-treatment apparatus which allows to increase the number of the treating cells without increasing the area occupied by the vacuum heat-treatment apparatus.

In accordance with the present invention, there is provided a vacuum heat-treatment apparatus for heat-treating a workpiece in a treating cell comprising a hermetic chamber disposed at the center, a plurality of treating cells disposed along the periphery of the hermetic chamber, and a workpiece transfer mechanism which is disposed inside the hermetic chamber and transfers the workpiece from one of the treating cells to the hermetic chamber and from the hermetic chamber to one of the treating cells.

The hermetic chamber and/or the treating cells may be provided in two or more stages in a vertical direction.

The workpiece transfer mechanism may comprise, for instance, a workpiece container in which the workpiece is contained, a rotating mechanism which changes the horizontal direction of the workpiece container, and an elevator mechanism which moves up and down the workpiece container.

One of the treating cells may be an oil hardening cell and the oil hardening cell may be disposed in a lower portion of the hermetic chamber.

The workpiece container may be provided with a telescopic lateral movement mechanism on which a basket containing therein the workpiece can be placed. Further, an oil hardening cell disposed along the periphery of the hermetic chamber may be employed as a workpiece input/output cell for taking the workpiece in the vacuum heat-treatment apparatus and discharging the treated workpiece therefrom.

One of the treating cells may be a gas cooling cell and the gas cooling cell may be employed as a workpiece input/output cell for taking the workpiece in the vacuum heat-treatment apparatus and discharging the treated workpiece therefrom.

When the treating cells are provided in two or more stages, it is preferred that the upper and lower treating cells be angularly shifted with respect to each other by half a pitch, i.e., half of the angle included between adjacent two treating cells in the same stage, in order to reserve a space for accommodating a motor for a cooling fan or the like projecting from the top of the treating cell.

In the vacuum heat-treatment apparatus of the present invention, since all the treating cells are disposed along the periphery of the hermetic chamber adjacent to the hermetic chamber, the workpiece can be transferred from one treating cell to another in a short time by way of the hermetic chamber and accordingly a later treatment of a series of vacuum heat treatments can be started within a desired time, whereby a high quality product can be obtained.

Further, the number of the treating cells can be increased according to the required throughput without increasing the area occupied by the vacuum heat-treatment apparatus by increasing the number of the treating cells disposed along the periphery of the hermetic chamber or by providing the hermetic chamber and/or the treating cells in two or more stages in a vertical direction. That is, since the vacuum heat-treatment apparatus of the present invention allows to three-dimensionally increase the treating cells, the throughput can be increased in a limited area.

When the workpiece transfer mechanism comprises a workpiece container in which the workpiece is contained, a rotating mechanism which changes the horizontal direction of the workpiece container and an elevator mechanism which moves up and down the workpiece container, the workpiece can be transferred from one of the treating cells to another by a minimum movement of the workpiece transfer mechanism and accordingly, the workpiece can be freely transferred to a desired treating cell in a short time.

When one of the treating cells is an oil hardening cell, the workpiece can be hardened in a short time by a minimum movement of the workpiece transfer mechanism. Further when the oil hardening cell is disposed in a lower portion of the hermetic chamber, the workpiece can be introduced into the oil hardening cell in substantially the same short time from any one of the treating cells in the same stage to be hardened, and accordingly, high quality products can be constantly obtained.

DESCRIPTION OF THE PREFERRED EMBODIMENTS

Figure 1:
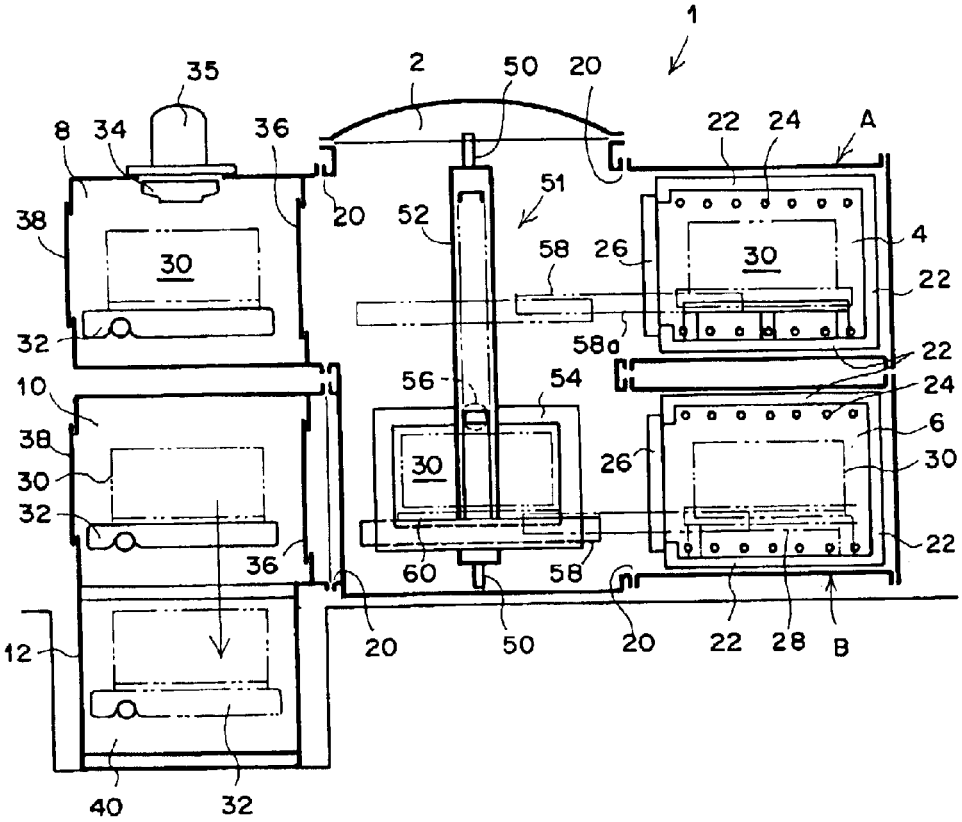
FIG. 1 is a cross-sectional view showing a vacuum heat-treatment apparatus in accordance with a first embodiment of the present invention.
Figure 2:
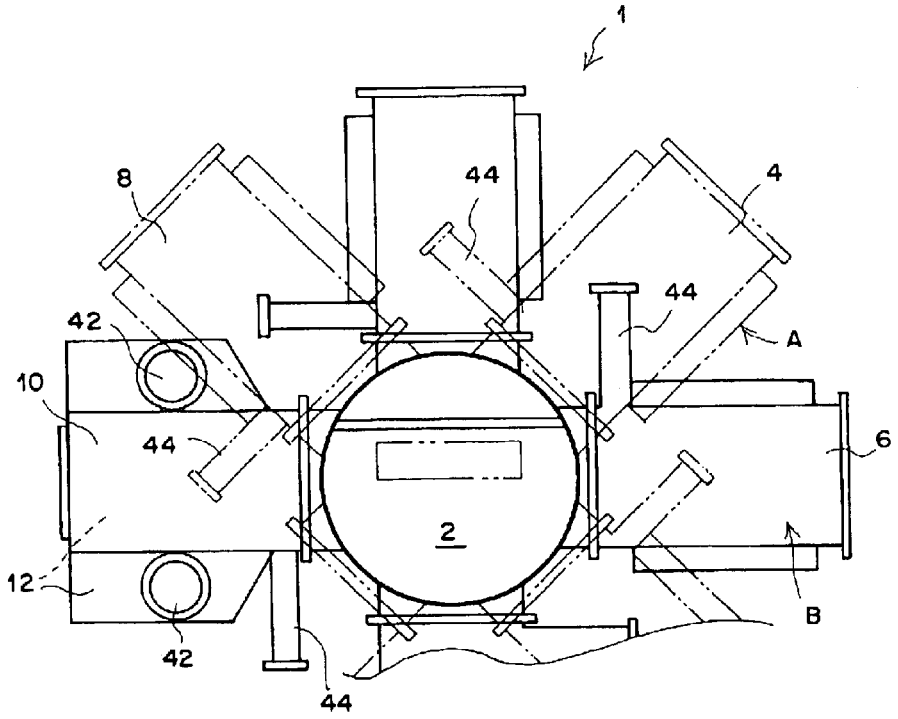
FIG. 2 is a fragmentary plan view of the vacuum heat-treatment apparatus of the first embodiment.

As shown in FIGS. 1 and 2, a vacuum heat-treatment apparatus 1 in accordance with a first embodiment of the present invention comprises a cylindrical hermetic chamber 2 and a plurality of treating cell 4, 6, 8, 10, . . . which are disposed along the periphery of the hermetic chamber 2 in two stages. Though the treating cells 4 and 8 in the upper stage are shown as aligned with the treating cells 6 and 10 in the lower stage for the purpose of simplicity in FIG. 1, actually they are angularly shifted with respect to each other by half a pitch as shown in FIG. 2. The "one pitch" as used here means the angle included between adjacent two treating cells in the same stage. That is, the treating cells 4, 8, . . . in the upper stage (will be referred to as "the upper treating cells A", hereinbelow) are disposed crosswise around the hermetic chamber 2 and the treating cells 6, 10, . . . in the lower stage (will be referred to as "the lower treating cells B", hereinbelow) are disposed crosswise around the hermetic chamber 2 with the lower cells B staggered with respect to the upper cells A by 45°. Further, an additional treating cell 12 is connected to the treating cell 10 below the treating cell 10.

Four rectangular openings 20 are formed in an upper portion of the periphery of the hermetic chamber 2 and a treating cell of the upper treating cells A is mounted on each of the openings 20 by means of a fastener such as a bolt (not shown). Similarly, four rectangular openings 20 are formed in a lower portion of the periphery of the hermetic chamber 2 and a treating cell of the lower treating cells B is mounted on each of the openings 20 by means of a fastener such as a bolt (not shown). Some of the openings 20 may be normally closed by a lid member and may be opened to mount thereon a treating cell when the treating cells are to be increased. The treating cells may be removably mounted on the hermetic chamber 2 or may be fixedly mounted on the hermetic chamber 2. In this particular embodiment, the treating cells 4 and 6 are hermetic heating chambers and the treating cell 8 is a gas cooling chamber.

Each of the hermetic heating chambers 4 and 6 comprises a heat insulating wall 22 provided along the inner surface of the chamber and a heater 24 which heats the inside of the chamber to a high temperature, thereby heating the workpiece. The heat insulating wall 22 is preferably of heat insulating material or heat-resistant material such as ceramics or graphite. Though not shown, the hermetic heating chambers 4 and 6 are respectively provided with temperature control means. The workpiece is, for instance, a metal part such as a gear or a shaft to be surface-hardened. The workpiece is placed on a table 28 in the hermetic heating chambers 4 and 6 with the heat insulating door 26 opened. After the heat insulating door 26 is shut, the workpiece is heated to a predetermined temperature, e.g., 1000° C. Reference numeral 30 denotes a metal basket which contains therein the workpiece. Further, the hermetic heating chambers 4 and 6 are evacuated together with the hermetic chamber 2 when heating the workpiece.

The gas cooling chamber 8 is provided with a chain-driven conveyor 32 and the workpiece heated in the hermetic heating chamber 4 or 6 is placed on the conveyor 32 and is hardened by gas cooling. The gas cooling chamber 8 is separated from the hermetic chamber 2 by a gas tight door 36 and the heated workpiece is transferred into the gas cooling chamber 8 through the hermetic chamber 2 with the door 36 opened. When the doors 26 and 36 are opened, they are accommodated in door pockets 44 (FIG. 2) provided in the vicinity thereof. The gas cooling chamber 8 is further provided with an outer door 38 and a workpiece to be treated is transferred into the chamber 8 with the outer door 38 opened. The conveyor 32 is used when the workpiece to be treated is transferred into the chamber 8. Further, the treated workpiece can be transferred outward with the outer door 38 opened. In this case, the cooling chamber 8 doubles as a workpiece input/output cell for taking the workpiece in the vacuum heat-treatment apparatus 1 and discharging the treated workpiece therefrom.

The treating cells 10 and 12 will be described, hereinbelow. The treating cells 10 and 12 are disposed in alignment with each other in a vertical direction. The upper cell 10 is provided with inner and outer gas tight doors 36 and 38 and is employed as a preparatory chamber, and the lower cell 12 is an oil hardening chamber having therein an oil reservoir. After the workpiece is contained in the preparatory chamber 10 through the opened outer door 38, the preparatory chamber 10 is once evacuated. Thereafter, inert gas such as nitrogen gas or argon gas is filled into the preparatory chamber 10 until the pressure in the preparatory chamber 10 is equalized to the pressure in the hermetic chamber 2, which is normally held lower than the atmospheric pressure. Thereafter, the inner door 36 is opened and the workpiece is transferred to another treating cell by a workpiece transfer mechanism, which will be described later. The hermetic chamber 2 is evacuated when heating the workpiece in the heating chamber 4 or 6 as described above.

The oil hardening chamber 12 below the preparatory chamber 10 is filled with hardening oil 40 and the heated workpiece is dipped in the hardening oil 40 to be hardened. That is, the inner door 36 of the preparatory chamber 10 is opened and the heated workpiece is once transferred into the preparatory chamber 10. Then the workpiece is suspended by a suspender (not shown), and the suspender is moved downward to dip the workpiece into the hardening oil 40. As shown in FIG. 2, the oil hardening chamber 12 extends beyond the edges of the preparatory chamber 10 on opposite sides thereof, and the hardening oil 40 is stirred by downward-directed stirrers driven by motors 42 in order to uniformly cool the workpiece. The motors 42 are disposed in the parts of the hardening chamber 12 extending beyond the edges of the preparatory chamber 10 on opposite sides thereof. In the embodiment described above and the following embodiments, each treating cell is provided with a vacuum valve (not shown) for evacuating the treating cell, a gas introduction valve (not shown) for introducing inert gas or carburizing gas as desired, and a bypass valve (not shown) for regulating the pressure in the treating cell.

The hermetic chamber 2 will be described, hereinbelow. As described above, the hermetic chamber 2 is cylindrical in shape, and a workpiece transfer mechanism 51 having a frame-like rail member 52 is disposed inside the hermetic chamber 2. The rail member 52 comprises a vertical shaft 50 erected at the center of the hermetic chamber 2 and is rotated about the vertical shaft 50 by a rotating mechanism (not shown).

A gondola (workpiece container) 54 is mounted on the rail member 52 to be moved up and down under the guidance of the rail member 52. The gondola 54 is moved up and down along the rail member 52 by an elevator mechanism including a cam follower 56 held by the rail member 52. When the rail member 52 is rotated by the rotating mechanism, the gondola 54 is rotated together with the rail member 52. Since the gondola 54 is rotated in the rail member 52, the moment required to rotate the gondola 54 may be small and accordingly, even a heavy workpiece can be rotated quickly. Further, the power required to rotated the workpiece may be small.

A telescopic lateral movement mechanism 58 is mounted on the gondola 54. The lateral movement mechanism 58 comprises a folk-like telescopic arm 58*a* which can be extended in two or three stages. The telescopic arm 58*a* is normally in a contracted state so that the lateral movement mechanism 58 can be rotated in the hermetic chamber 2 together with the gondola 54. A tray 60 is mounted on the end of the telescopic arm 58*a* and the basket 30 is mounted on the tray 60 so that the basket 30 is moved laterally or horizontally as the telescopic arm 58*a* extends. The rotating mechanism, the elevator mechanism and the lateral movement mechanism 58 are driven by a driver (not shown) such as comprising an electric motor or a hydraulic cylinder.

The vacuum heat treatment will be described, hereinbelow. The workpiece is transferred into, for instance, the treating cell 10, and the treating cell 10 is evacuated to purge air including oxygen therefrom in order to prevent oxidization of the workpiece. Thereafter, the workpiece is transferred to, for instance, the hermetic heating chamber 4, which has been held vacuum, by the workpiece transfer mechanism 51 through the hermetic chamber 2, which has been held vacuum. In the hermetic heating chamber 4, the workpiece is heated. Though depending upon the size, material, amount and the like of the workpiece, the heating time generally exceeds two hours and sometimes ten and several times.

After the initiation of the heating, the temperature of the workpiece gradually increases and carburizing gas, for instance, carbon-containing gas such as acetylene gas is introduced into the hermetic heating chamber 4 when the temperature of the workpiece reaches a predetermined temperature. Then the workpiece is kept heated for a predetermined time, whereby carbon components in the carburizing gas penetrates into the surface of the workpiece and the metal surface is converted into cementite. As the vacuum carburizing time is increased, the carbon components penetrates deeper into the workpiece. When the time required for the carbon components to penetrate to a desired depth lapses, the heating is ended. Thereafter, inert gas is supplied to the workpiece and a so-called diffusion step in which the carbon in the metal is diffused so that the carbon concentration in the metal surface is lowered is carried out. When the carbon concentration in the metal surface is lowered to a predetermined value, e.g., 0.8%, the vacuum heat treatment (vacuum carburizing) is ended.

When heat treatment is ended the inner door 26 of the hermetic heating chamber (treating cell) 4 is opened and the telescopic arm 58*a* of the lateral movement mechanism 58 is extended into the hermetic heating chamber 4. Then after the basket 30 in which the workpiece is contained is held by the tray 60 on the telescopic arm 58*a*, the telescopic arm 58*a* is contracted to transfer the basket 30 or the workpiece to the hermetic chamber 2. When the workpiece is to be subsequently gas-cooled, the gas tight door 36 of the gas cooling chamber 8 is opened and the telescopic arm 58*a* is extended to transfer the workpiece into the gas cooling chamber 8. Thereafter, the door 36 is shut to close the gas cooling chamber 8 in an airtight fashion. In this state, inert gas such as nitrogen gas or helium gas is filled into the gas cooling chamber 8 and the workpiece is cooled by the inert gas with the inert gas stirred by a fan 34 driven by an electric motor 35, whereby the workpiece is hardened (surface treatment). When the workpiece is hardened by the use of gas, hardening progresses relatively slowly due to small specific heat of gas. In the case where crack and/or deformation is generated in the workpiece when the workpiece is rapidly cooled, the gas cooling process is employed.

When the workpiece is to be subsequently oil-hardened in the hermetic oil-hardening chamber 12, the gondola 54 is once lowered to the level of the lower treating cells B and the workpiece is once transferred to the preparatory chamber 10 by the lateral movement mechanism 58. Then the workpiece is dipped in the hardening oil 40 in the chamber 12 and is rapidly cooled so that the metal surface is converted into martensite from austenite. The temperature of the hardening oil 40 at this time is about 60 to 200° C. and preferably 150° C. In order to prevent boiling of the hardening oil 40, the inner pressure of the hermetic oil hardening chamber 12 is increased.

Hardening normally requires 15 to 20 minutes whereas vacuum carburizing requires 2 or more hours as described above. Accordingly, in the vacuum heat-treatment apparatus 1 of this embodiment, the hermetic heating chambers are more than the hardening chambers (the gas cooling chamber 8 and the oil hardening chamber 12) so that the treating cells are efficiently worked without idling the hardening chambers. Both the gas cooling chamber 8 and the hermetic oil hardening chamber 12 may be provided in the vacuum heat-treatment apparatus 1 or either of the gas cooling chamber 8 and the hermetic oil hardening chamber 12 may be provided in the vacuum heat-treatment apparatus 1 according to the application. In the case where both the gas cooling chamber 8 and the hermetic oil hardening chamber 12 are provided, one of the hardening chambers may be selected according to the material of the workpiece. For example, when the workpiece is SKD, the gas cooling chamber 8 is to be selected.

Figure 3:
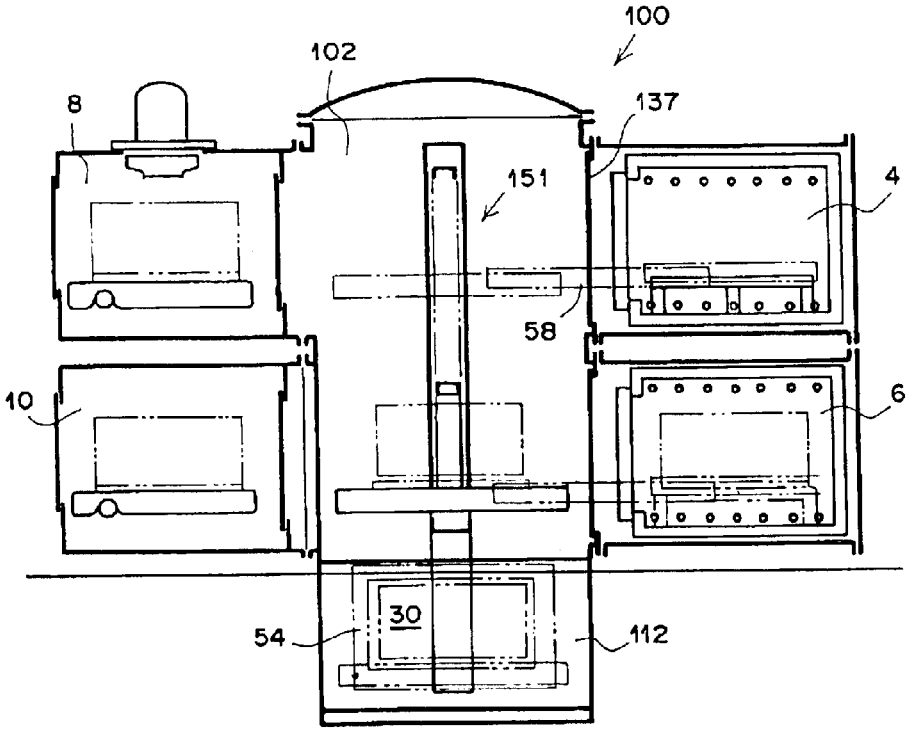
FIG. 3 is a cross-sectional view similar to FIG. 1 showing a vacuum heat-treatment apparatus in accordance with a second embodiment of the present invention.

A vacuum heat-treatment apparatus in accordance with a second embodiment of the present invention will be described with reference to FIG. 3, hereinbelow. The elements analogous to those shown in FIG. 1 are given the same reference numerals and will not be described here. The vacuum heat-treatment apparatus of this embodiment differs from that of the first embodiment in that a hermetic oil hardening chamber 112 is disposed below a hermetic chamber 102. When the hermetic oil hardening chamber 112 is used, the pressure in the chamber 112 is increased and when hermetic heating chambers 4 and 6 are used, the chambers are evacuated. Accordingly, the hermetic chamber 102 is separated from the treating cell 4 or 6 by an air tight door 137. The application and the arrangement of the treating cells 4, 6, 8 and 10 are same as in the vacuum heat-treatment apparatus 1 of the first embodiment.

In this embodiment, since being disposed below the hermetic chamber 2, the hermetic oil hardening chamber 112 is substantially at the same distance from all the treating cells in the same stage, whereby the workpiece can be hardened in a short time. For example, workpieces vacuum-carburized in the treating cells 4 and 6 are transferred to the hermetic chamber 102 by the workpiece transfer mechanism 151 and then the workpiece can be immediately introduced into the hermetic oil hardening chamber 102 by lowering the gondola 54. That is, it is not necessary to once stop the gondola 54 at the level of another stage and then to move the workpiece in the gondola 54 to another treating cell by the lateral movement mechanism, which shortens the time required to dip the workpiece in the hardening oil. In this embodiment, the workpiece transfer mechanism 151 is longer than the workpiece transfer mechanism 51 in the first embodiment and is arranged to be able to stop the gondola 54 at three levels opposed to the respective stages.

Figure 4:
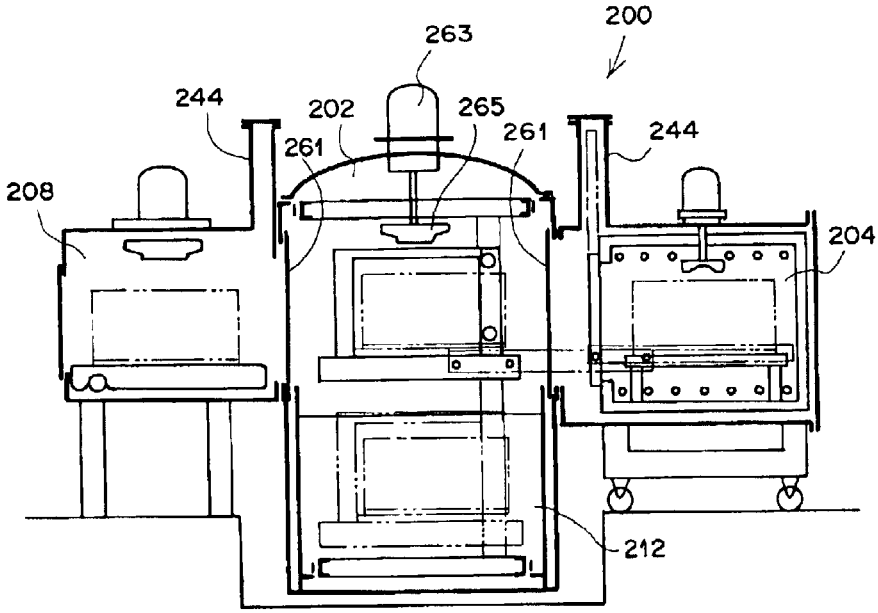
FIG. 4 is a cross-sectional view similar to FIG. 1 showing a vacuum heat-treatment apparatus in accordance with a third embodiment of the present invention.
Figure 5:
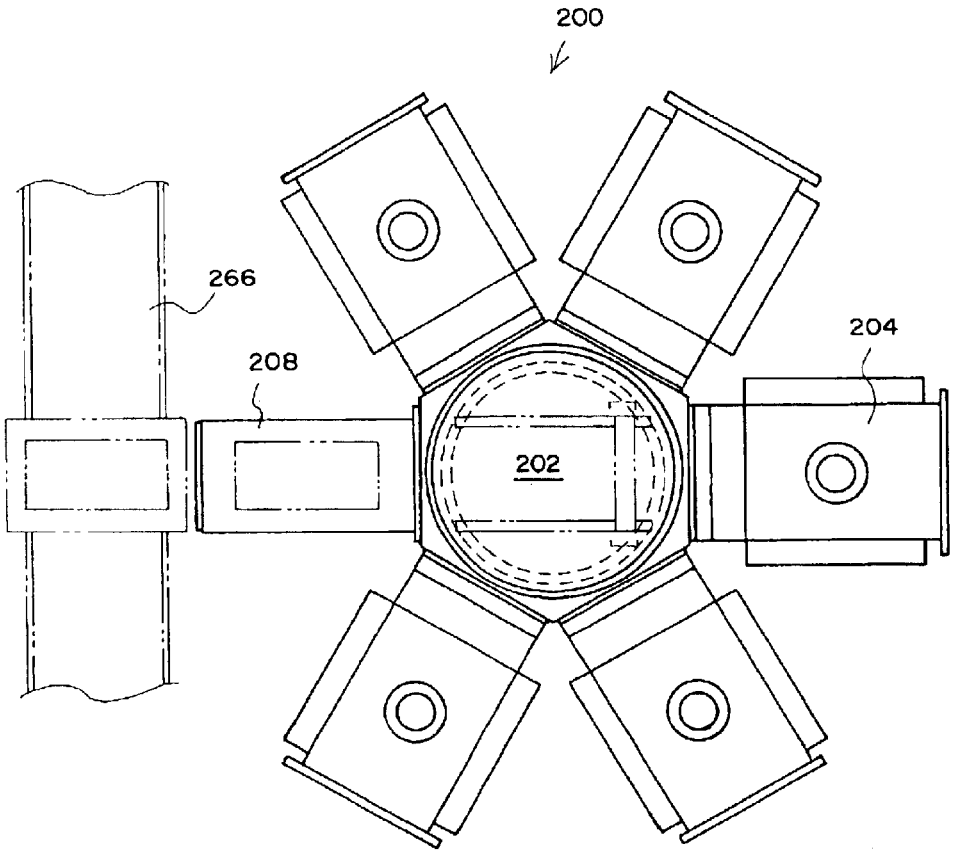
FIG. 5 is a plan view of the vacuum heat-treatment apparatus in accordance with the third embodiment of the present invention.

A vacuum heat-treatment apparatus 200 in accordance with a third embodiment of the present invention will be described with reference to FIGS. 4 and 5, hereinbelow. In the vacuum heat-treatment apparatus 200 of this embodiment, a hermetic heating chamber 204 and a gas cooling chamber 208 are radially disposed about a hermetic chamber 202 in one stage as shown in FIG. 5, and an oil hardening chamber 212 is disposed in a lower portion of the hermetic chamber 202. The hermetic chamber 202 is separated from each of the treating cells by an air tight door 261. The door pockets 244 in which the doors are accommodated projects upward of the treating cells. The hermetic chamber 202 is separated from each of the treating cells by an air tight door 261. These air tight doors 261 are for accommodating the difference in pressure between the hermetic chamber 202 and each of the treating cells. In this embodiment, the upper portion of the hermetic chamber 202 is provided with a fan 265 driven by an electric motor 263 and may be employed as a gas cooling chamber. In FIG. 5, the path along which the workpiece is transferred is shown by chained line 266. In this embodiment, since the oil hardening cell 212 is disposed in a lower portion of the hermetic chamber 202, the workpiece can be hardened in a short time as in the second embodiment.

Figure 6:
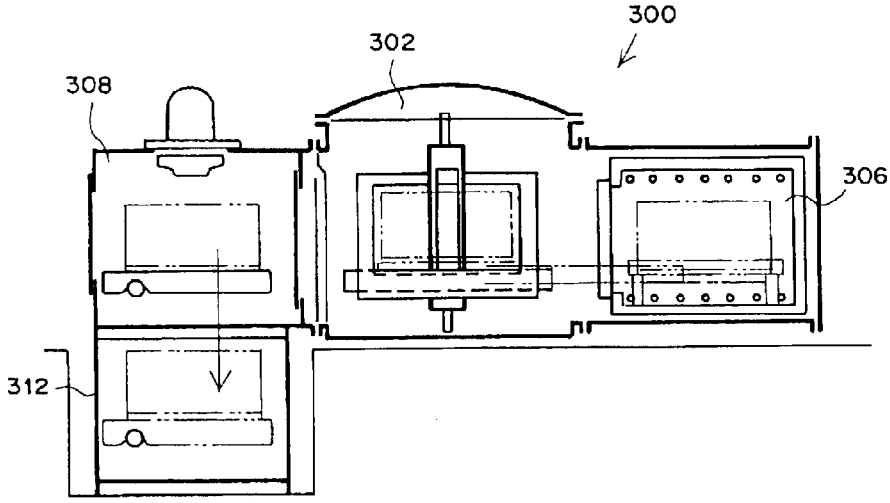
FIG. 6 is a cross-sectional view similar to FIG. 1 showing a vacuum heat-treatment apparatus in accordance with a fourth embodiment of the present invention.

A vacuum heat-treatment apparatus 300 in accordance with a fourth embodiment of the present invention will be described with reference to FIG. 6, hereinbelow.

In the vacuum heat-treatment apparatus 300 of this embodiment, a hermetic heating chamber 306 and a gas cooling chamber 308 are disposed about a one-stage hermetic chamber 302 and a hermetic oil hardening chamber 312 is disposed below the gas cooling chamber 308. In the vacuum heat-treatment apparatus 300, the workpiece is treated in the same manner as in the vacuum heat-treatment apparatus 1 of the first embodiment.

The treating cells may be arranged about a hermetic chamber two-dimensionally or in one stage. Also in this case, a workpiece transfer mechanism comprising an elevator mechanism for moving up and down the gondola and a rotating mechanism is provided in the hermetic chamber.

As can be understood from the description above, in the vacuum heat-treatment apparatuses 1, 100, 200 and 300 of the embodiments described above, since a plurality of treating cells are disposed along the outer periphery of a hermetic chamber, treating cells can be increased in a circumferential direction or in a vertical direction, whereby the throughput can be increased without increasing the area occupied by the vacuum heat-treatment apparatus, and at the same time the workpiece can be dipped in the hardening oil within about one minute before the heated workpiece is cooled, whereby a high quality product can be obtained. Especially when the oil hardening chamber is disposed below the hermetic chamber, the workpiece can be dipped in the hardening oil in a shorter time, this ensures to obtain a high quality product even if the workpiece is small and temperature drop of the workpiece is rapid.

The hermetic chamber need not be cylindrical but may be, for instance, square or polygonal.

What is claimed is:

1. A vacuum heat-treatment apparatus for heat-treating a workpiece in a treating cell comprising:

a centrally disposed hermetic chamber, a plurality of individual treating cells each arranged exteriorly of the hermetic chamber in a circumferentially spaced apart manner along the periphery of the hermetic chamber, and a workpiece transfer mechanism which is disposed inside the hermetic chamber to transfer the workpiece from one of the treating cells to the hermetic chamber and from the hermetic chamber to one of the treating cells, wherein the at least one of the plurality of treating cells are further arranged in two or more vertical stages on the periphery of the hermetic chamber, and wherein one of the plurality of treating cells of a lowermost vertical stage is positioned directly above and connected to an upper portion of an oil hardening cell to permit lowering/raising of a workpiece into the oil hardening cell from said treating cell of the lowermost vertical stage.

2. A vacuum heat-treatment apparatus as defined in claim 1 in which the workpiece transfer mechanism comprises a workpiece container in which the workpiece is contained, a rotating mechanism which changes the horizontal direction of the workpiece container, and an elevator mechanism which moves up and down the workpiece container.

3. A vacuum heat-treatment apparatus as defined in claim 1 in which one of the treating cells is a gas cooling cell.

4. A vacuum heat-treatment apparatus as defined in claim 1 wherein the treating cells of each vertical stage are vertically offset with respect to the treating cells of an adjacent stage.

5. A vacuum heat-treatment apparatus for heat-treating a workpiece in a treating cell comprising:

a hermetic chamber disposed at the center of the vacuum heat-treatment apparatus, a plurality of treating cells disposed along the periphery of the hermetic chamber, and a workpiece transfer mechanism which is disposed inside the hermetic chamber and transfers the workpiece from one of the treating cells to the hermetic chamber and from the hermetic chamber to one of the treating cells, and another treating cell which is an oil hardening cell disposed below and directly connected to a lower portion of the hermetic chamber to permit lowering/raising of a workpiece into the oil hardening cell from said hermetic chamber.

6. A vacuum heat-treatment apparatus as defined in claim 5 in which the workpiece transfer mechanism comprises a workpiece container in which the workpiece is contained, a rotating mechanism which changes the horizontal direction of the workpiece container, and an elevator mechanism which moves up and down the workpiece container.

7. A vacuum heat-treatment apparatus as defined in claim 5 in which one of the treating cells is a gas cooling cell.

8. A vacuum heat-treatment apparatus as defined in claim 5 wherein at least one of the plurality of treating cells are further arranged in two or more vertical stages on the periphery of the hermetic chamber.

9. A vacuum heat-treatment apparatus for heat-treating a workpiece in a treating cell comprising:

a hermetic chamber disposed at the center of the heat-treatment apparatus, a plurality of treating cells disposed along the periphery of the hermetic chamber, and a workpiece transfer mechanism which is disposed inside the hermetic chamber and transfers the work piece from one of the treating cells to the hermetic chamber and from the hermetic chamber to one of the treating cells wherein one of the treating cells is a cooling cell, wherein one of the plurality of treating cells is positioned directly above and connected to an upper portion of an oil hardening cell to permit lowering/raising of a workpiece into the oil hardening cell from said one of the plurality of treating cells.

10. A vacuum heat-treatment apparatus as defined in claim 9 in which the workpiece transfer mechanism comprises a workpiece container in which the workpiece is contained, a rotating mechanism which changes the horizontal direction of the workpiece container, and an elevator mechanism which moves up and down the workpiece container.

11. A vacuum heat-treatment apparatus as defined in claim 9 in which one of the treating cells is a gas cooling cell.

* * * * *